US011774180B2

(12) United States Patent
Wang et al.

(10) Patent No.: US 11,774,180 B2
(45) Date of Patent: Oct. 3, 2023

(54) HEAT PIPE AND HEAT DISSIPATION STRUCTURE

(71) Applicant: VAST GLORY ELECTRONICS & HARDWARE & PLASTIC(HUI ZHOU) LTD., Hui Zhou (CN)

(72) Inventors: Xue Mei Wang, Hui Zhou (CN); Lei Lei Liu, Hui Zhou (CN)

(73) Assignee: VAST GLORY ELECTRONICS & HARDWARE & PLASTIC(HUI ZHOU) LTD., Hui Zhou (CN)

( * ) Notice: Subject to any disclaimer, the term of this patent is extended or adjusted under 35 U.S.C. 154(b) by 151 days.

(21) Appl. No.: 17/177,551

(22) Filed: Feb. 17, 2021

(65) Prior Publication Data

US 2022/0136778 A1 May 5, 2022

(30) Foreign Application Priority Data

Nov. 5, 2020 (CN) ..... 202022531069.0

(51) Int. Cl.
*F28D 15/02* (2006.01)
*F28F 1/00* (2006.01)
*F28F 21/08* (2006.01)

(52) U.S. Cl.
CPC ..... *F28D 15/0233* (2013.01); *F28D 15/0266* (2013.01); *F28F 1/006* (2013.01); *F28F 21/085* (2013.01); *F28F 2215/02* (2013.01)

(58) Field of Classification Search
CPC .. F28D 15/0233; F28D 15/0266; F28F 1/006; F28F 21/085; F28F 2215/02
USPC ..... 165/104.21
See application file for complete search history.

(56) References Cited

U.S. PATENT DOCUMENTS

| | | | | |
|---|---|---|---|---|
| 7,852,630 | B2 * | 12/2010 | Cheng | F25B 21/00 257/713 |
| D954,005 | S * | 6/2022 | Inagaki | D13/179 |
| 2005/0045310 | A1 * | 3/2005 | Okutsu | F28D 15/04 257/E23.099 |
| 2009/0109621 | A1 * | 4/2009 | Cheng | F28D 15/0233 361/697 |
| 2017/0307299 | A1 * | 10/2017 | Huang | F28D 15/02 |
| 2018/0128552 | A1 * | 5/2018 | Ito | F28D 15/02 |
| 2020/0326131 | A1 * | 10/2020 | Hikichi | F28D 15/0275 |
| 2020/0340755 | A1 * | 10/2020 | Horng | F28D 15/0266 |
| 2020/0355443 | A1 * | 11/2020 | Tochigi | H01L 23/427 |
| 2021/0018272 | A1 * | 1/2021 | Inagaki | F28D 15/046 |
| 2021/0318072 | A1 * | 10/2021 | Ito | F28D 15/02 |
| 2021/0325120 | A1 * | 10/2021 | Lin | F28D 15/0266 |

* cited by examiner

*Primary Examiner* — Jon T. Schermerhorn, Jr.
(74) *Attorney, Agent, or Firm* — Maschoff Brennan

(57) ABSTRACT

A heat pipe including a pipe body. The pipe body has an evaporation portion and a condensation portion. The condensation portion is connected to the evaporation portion. The condensation portion includes a condensation end. The evaporation portion includes an evaporation end. The evaporation end and/or the condensation end are/is in a rectangular shape.

7 Claims, 3 Drawing Sheets

HEAT PIPE AND HEAT DISSIPATION STRUCTURE

CROSS-REFERENCE TO RELATED APPLICATIONS

This non-provisional application claims priority under 35 U.S.C. § 119(a) on Patent Application No(s). 202022531069.0 filed in China, on Nov. 5, 2020, the entire contents of which are hereby incorporated by reference.

TECHNICAL FIELD

The disclosure relates to a thermally conductive component, more particularly to a heat pipe and a heat dissipation structure having the heat pipe.

BACKGROUND

Heat pipe is a hollow pipe made of metal material and effectively transfers heat between two solid interfaces. The heat pipe can be used in various applications, such as the aerospace field, and recently is widely used as a heat exchanger or a cooler for civil use.

However, in practical, both of the contact areas of the condensation end or the evaporation end of the heat are small, resulting low heat exchange efficiency. As the requirements of a thinning and light weight electronic device increase, the heat exchange efficiency of the heat dissipation device disposed in such electronic device should be improved as much as possible. Thus, it is required to develop a heat pipe with improved heat exchange efficiency and a heat dissipation structure having such heat pipe.

SUMMARY

The disclosure provides a heat pipe and a heat dissipation structure having improved heat exchange efficiency.

One embodiment of this disclosure provides a heat pipe including a pipe body. The pipe body has an evaporation portion and a condensation portion. The condensation portion is connected to the evaporation portion. The condensation portion includes a condensation end. The evaporation portion includes an evaporation end. The evaporation end and/or the condensation end are/is in a rectangular shape.

According to a heat pipe according to an embodiment of the disclosure, the condensation portion further includes a condensation pipe wall. The evaporation portion further includes an evaporation pipe wall. The evaporation pipe wall and/or the condensation pipe wall are/is in a rectangular shape.

According to a heat pipe according to an embodiment of the disclosure, the heat pipe further includes a connection portion. An end of a pipe wall of the connection portion is connected to the evaporation pipe wall, and another end of the pipe wall of the connection portion is connected to the condensation pipe wall.

According to a heat pipe according to an embodiment of the disclosure, the pipe wall of the connection portion is in a regular circular, oval, elliptical or rectangular shape.

According to a heat pipe according to an embodiment of the disclosure, an end of the evaporation pipe wall that is located close to the pipe wall of the connection portion has a first bent part, and the first bent part is connected to the pipe wall of the connection portion.

According to a heat pipe according to an embodiment of the disclosure, a pipe wall of the connection portion has a second bent part.

According to a heat pipe according to an embodiment of the disclosure, the evaporation end has a first length and a first width. The first length is the same as or different from the first width. The condensation end has a second length and a second width, and the second length is the same as or different from the second width.

According to a heat pipe according to an embodiment of the disclosure, the evaporation end and/or the condensation end has four rounded corners, and radii of the four rounded corners are constant and are smaller than 0.5 mm.

The disclosure further provides a heat dissipation structure including a copper substrate, a heat dissipation fin assembly and the above heat pipe. The evaporation end of the evaporation portion of the heat pipe is in contact with the copper substrate, and the condensation end of the condensation portion of the heat pipe is in contact with the heat dissipation fin assembly.

The disclosure further provides a heat dissipation structure including a copper substrate, a base and the above heat pipe. The evaporation end of the evaporation portion of the heat pipe is in contact with the copper substrate, and the condensation end of the condensation portion of the heat pipe is in contact with the base.

According to the heat pipe and the heat dissipation structure disclosed by above embodiments, comparing to the prior art, the heat exchange area of the heat pipe of the disclosure is significantly increased, such that the heat exchange efficiency thereof is improved and more inner space of the electronic device is saved. In particular, when the heat pipe has a length larger than 400 mm, the condensation portion of the heat pipe has a larger heat exchange area to effectively transferring the heat, thereby improving the heat exchange efficiency.

The summary and the following detail descriptions of the disclosure are used to demonstrate and explain the principle of the disclosure and provide a further explanation of the claims.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
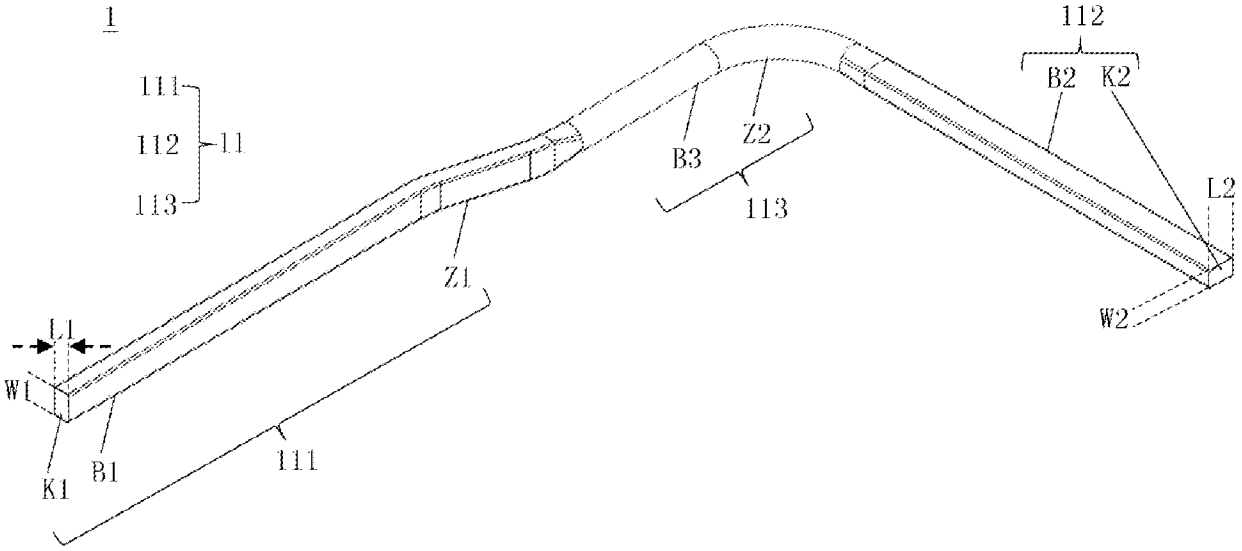
FIG. 1 shows a structure of a heat pipe according the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
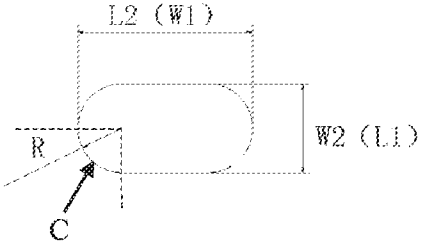
FIG. 2 shows structures of an evaporation end and/or a condensation end in FIG. 1.

Please refer to FIG. 1 and FIG. 2, where FIG. 1 shows a structure of a heat pipe 1 according the disclosure, and FIG. 2 shows structures of an evaporation end K1 and/or a condensation end K2 in FIG. 1. As shown in FIG. 1 and FIG. 2, in this embodiment, the heat pipe 1 includes a pipe body 11. The pipe body 11 has an evaporation portion 111 and a condensation portion 112 connected to the evaporation portion 111. The condensation portion 112 includes the condensation end K2. The evaporation portion 111 includes the evaporation end K1. The evaporation end K1 and/or the condensation end K2 are/is in a rectangular shape.

In this embodiment, both of the evaporation end K1 and the condensation end K2 are in a rectangular shape, but the embodiment is not limited thereto. In other embodiments, one of the evaporation end K1 and the condensation end K2 may be designed to be in a rectangular shape, and the other one may be designed to be in another shape depending on the desired design.

The heat pipe 1 provided by the disclosure has the evaporation end K1 and/or the condensation end K2 of the rectangular shape, such that the effective contact area of the heat pipe 1 is increased, thereby improving the heat exchange efficiency of the heat pipe 1. In specific, when the single condensation end K2 is in a rectangular shape, the heat exchange efficiency can be increased by 20% to 30% or more.

Additionally, the evaporation portion 111 further includes an evaporation pipe wall B1. The condensation portion 112 further includes a condensation pipe wall B2. The evaporation pipe wall B1 and/or condensation pipe wall B2 are/is in a rectangular shape. Specifically, the evaporation pipe wall B1 has two opposite ends and extends between the two opposite ends, the evaporation end K1 is connected to an end of the evaporation pipe wall B1, and the other end of the evaporation pipe wall B1 is located closer to the condensation end K2. The condensation pipe wall B2 has two opposite ends and extends between the two opposite ends, the condensation end K2 is connected to an end of the condensation pipe wall B2, and the other end of the condensation pipe wall B2 is located closer to the evaporation end K1. The heat pipe 1 provided by the disclosure further includes a connection portion 113. Two opposite ends of a pipe wall B3 of the connection portion 113 are respectively connected to the evaporation pipe wall B1 and the condensation pipe wall B2.

Note that, in this embodiment, the pipe wall B3 of the connection portion 113 is in a regular circular shape, but the disclosure is not limited thereto. In another embodiment of the disclosure, the pipe wall B3 of the connection portion 113 may be in an oval (elliptical) or other irregular circular shapes, such as a flattened oval (elliptical) shape. In still another embodiment of the disclosure, the pipe wall B3 of the connection portion 113 may be in a rectangular shape as the same as the evaporation end K1 and/or the condensation end K2.

Moreover, the end of the evaporation pipe wall B1 that is located close to the pipe wall B3 of the connection portion 113 has a first bent part Z1. The first bent part Z1 is connected to the pipe wall B3 of the connection portion 113. The pipe wall B3 of the connection portion 113 has a second bent part Z2.

Furthermore, the evaporation end K1 has a first length L1 and a first width W1. The first length L1 is the same as or different from the first width W1. The condensation end K2 has a second length L2 and a second width W2. The second length L2 is the same as or different from the second width W2. In this embodiment, the second length L2 is greater than the second width W2, and the first length L1 is smaller than the first width W1, but the disclosure is not limited thereto. The first length L1, the first width W1, the second length L2 and the second width W2 may be modified according to actual requirements. In other embodiments, the first length L1 may be greater than or equal to the first width W1, and the second length L2 may be smaller than or equal to the second width W2.

In addition, the evaporation end K1 and/or the condensation end K2 have/has four rounded corners C. Curvature radii R of the rounded corners C are constant and are smaller than 0.5 mm.

In this embodiment, both of the evaporation end K1 and the condensation end K2 have four rounded corners C, but the disclosure is not limited thereto. In other embodiments, only the evaporation end K1 or the condensation end K2 may have four rounded corners C according to the desired design.

Figure 3:
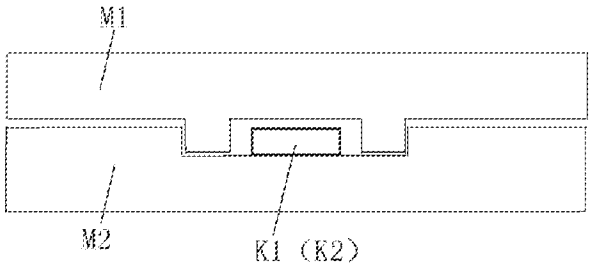
FIG. 3 shows the manufacturing process of the evaporation end and/or the condensation end.

Please refer to FIG. 3 showing the manufacturing process of the evaporation end K1 and/or the condensation end K2. As shown in FIG. 3, a top mold M1 and a bottom mold M2 are used. Thickness and width limitation are important sizes, and the top and bottom mold are mated at right angle. Because all of the surfaces are restricted, a minimum restriction is provided to the rounded corners C located on both sides, where the curvature radii R are smaller than or equal to 0.5 mm. Comparing to a conventional heat pipe with the same specification (having a diameter of 8 mm and flattened by 5.0 mm), the condensation heat exchange area of the heat pipe provided by the disclosure is increased by about 124% of that of regular design. If the side surface is not taken into account, it is increased by about 51%, and with regard to the performance, the heat exchange efficiency of the heat pipe provided by the disclosure may be increased by about 20% to 30%.

Figure 4:
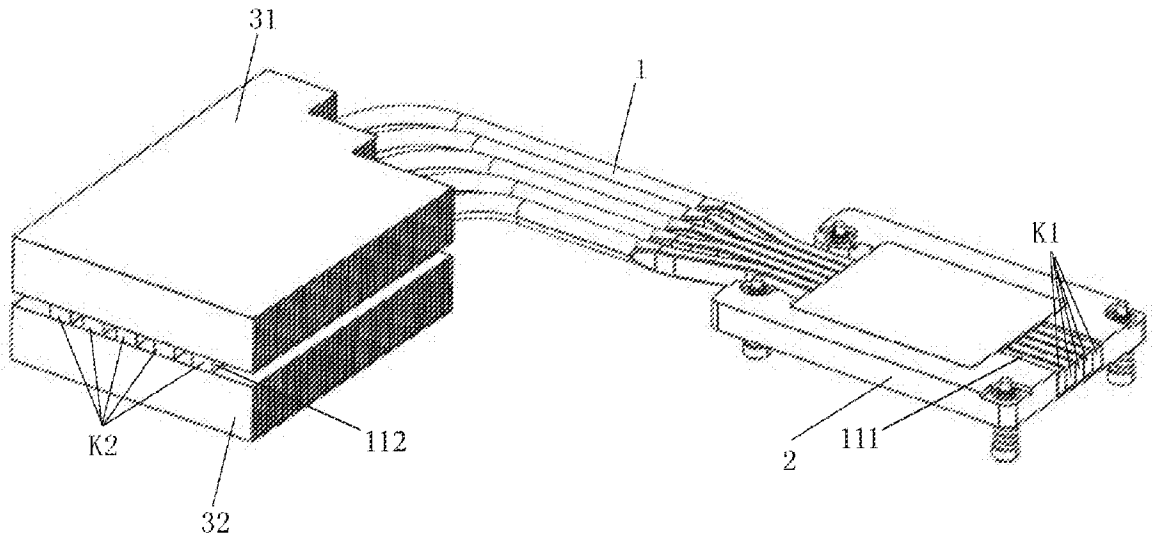
FIG. 4 shows a structure of a heat dissipation structure according to a first embodiment of the disclosure.

Please refer to FIG. 4 showing a structure of a heat dissipation structure according to a first embodiment of the disclosure. As shown in FIG. 4, the heat dissipation structure includes a copper substrate 2, two heat dissipation fin assemblies 31 and 32 (or may be referred as heat sinks) and a plurality of heat pipes 1. The evaporation end K1 of the evaporation portion 111 of each heat pipe 1 is in contact with and thermally coupled to the copper substrate 2. The condensation end K2 of the condensation portion 112 of each heat pipe 1 is in contact with and thermally coupled to the heat dissipation fin assemblies 31 and 32 and is located between the heat dissipation fin assemblies 31 and 32.

Figure 5:
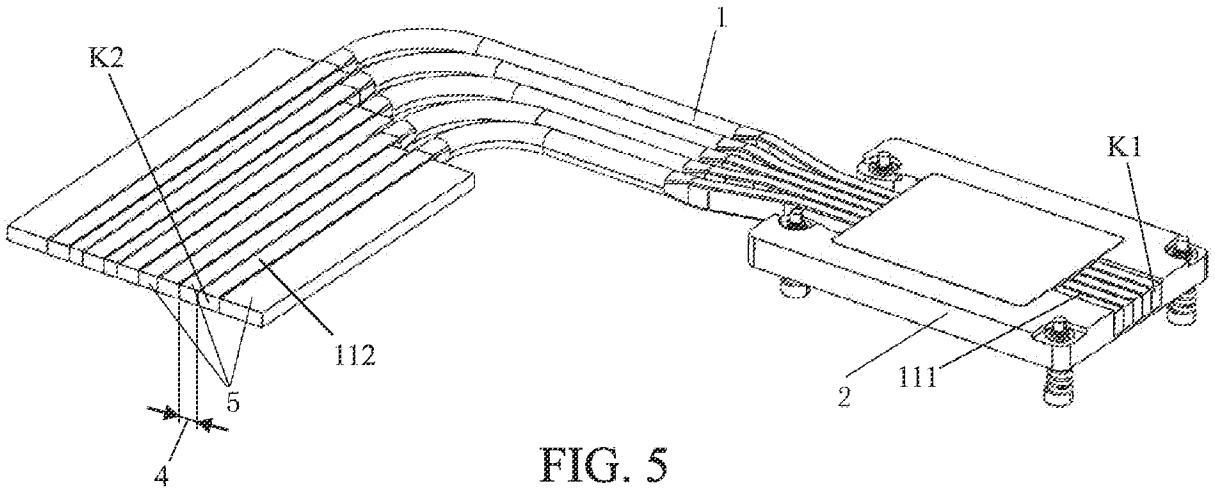
FIG. 5 shows a structure of a heat dissipation structure according to a second embodiment of the disclosure.

Please refer to FIG. 5 showing a structure of a heat dissipation structure according to a second embodiment of the disclosure. As shown in FIG. 5, the heat dissipation structure includes a copper substrate 2, at least two bases 5 and a plurality of heat pipes 1. The evaporation end K1 of the evaporation portion 111 of each heat pipe 1 is in contact with and thermally coupled to the copper substrate 2. A condensation end K2 of a condensation portion 112 of each heat pipe 1 is in contact with the base 5. The condensation ends K2 of the plurality of heat pipes 1 are spaced apart from one another by a gap 4.

Note that, in another embodiment of the disclosure, the condensation ends K2 of the heat pipes 1 may be attached to form a condensation end bundle, and the two bases 5 are disposed on two sides of the attached condensation end bundle, respectively.

Figure 6:
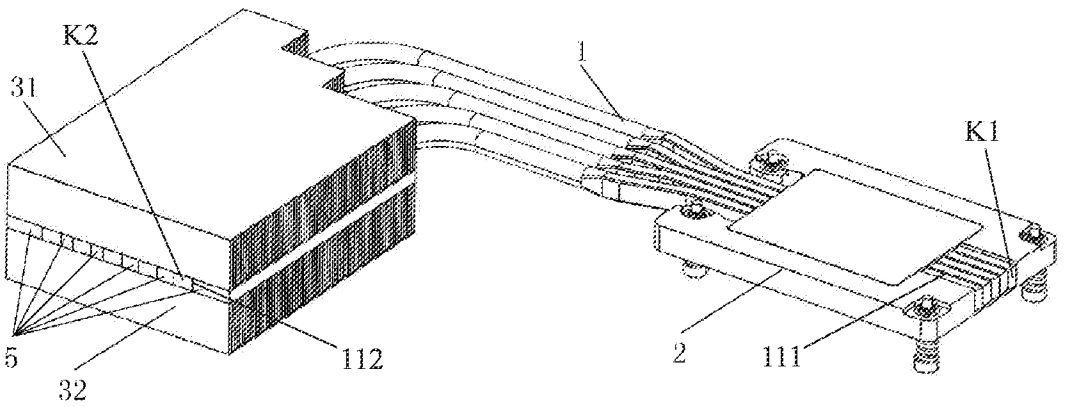
FIG. 6 shows a structure of a heat dissipation structure according to a third embodiment of the disclosure.

Please refer to FIG. 6 showing a structure of a heat dissipation structure according to a third embodiment of the disclosure. As shown in FIG. 6, the heat dissipation structure includes a copper substrate 2, two heat dissipation fin assemblies 31 and 32, at least two bases 5 and a plurality of heat pipes 1. The evaporation end K1 of the evaporation portion 111 of each heat pipe 1 is in contact with and thermally coupled to the copper substrate 2. The condensation end K2 of the condensation portion 112 of each heat pipe 1 is in contact with and thermally coupled to the bases 5 and the heat dissipation fin assemblies 31 and 32, and is located between the heat dissipation fin assemblies 31 and 32. Specifically, the condensation ends K2 of the heat pipes 1 are spaced apart from one another by the bases 5.

Note that, in another embodiment of the disclosure, the condensation ends K2 of the heat pipes 1 may be attached to form a condensation end bundle, and the two bases 5 are disposed on two sides of the attached condensation end bundle, respectively.

Note that, in this disclosure, the base 5 is made of metal, preferably aluminum, but the disclosure is not limited thereto.

According to the heat pipe and the heat dissipation structure disclosed by above embodiments, comparing to the prior art, the heat exchange area of the heat pipe of the disclosure is significantly increased, such that the heat exchange efficiency thereof is improved and more inner space of the electronic device is saved. In particular, when the heat pipe has a length larger than 400 mm, the condensation portion of the heat pipe has a larger heat exchange area to effectively transferring the heat, thereby improving the heat exchange efficiency.

Although the disclosure is described by the above embodiments, they are not intended to limit the disclosure. A person skill in the art can make some modifications and variations without departing from the spirit and scope of the disclosure, and thus the scope of the disclosure indicated by the following claims.

What is claimed is:

1. A heat pipe, comprising:

a pipe body, the pipe body having an evaporation portion and a condensation portion, the condensation portion connected to the evaporation portion, the condensation portion comprising a condensation end, the evaporation portion comprising an evaporation end, and the evaporation end and/or the condensation end are/is in a rectangular shape, the condensation portion further comprises a condensation pipe wall, the evaporation portion further comprises an evaporation pipe wall;

a connection portion, wherein an end of a pipe wall of the connection portion is connected to the evaporation pipe wall, and another end of the pipe wall of the connection portion is connected to the condensation pipe wall;

wherein an end of the evaporation pipe wall that is located close to the pipe wall of the connection portion has a first bent part, and the first bent part is connected to the pipe wall of the connection portion, the evaporation pipe wall and the first bent part are in a rectangular shape, the pipe wall of the connection portion is in a circular shape and the first bent part is not parallel to the evaporation pipe wall and the pipe wall of the connection portion, and the evaporation end has a first length and a first width, the first length is different from the first width, the condensation end has a second length and a second width, and the second length is different from the second width.

2. The heat pipe according to claim 1, wherein the evaporation pipe wall and/or the condensation pipe wall are/is in a rectangular shape.

3. The heat pipe according to claim 1, wherein a pipe wall of the connection portion has a second bent part.

4. The heat pipe according to claim 1, wherein the evaporation end and/or the condensation end has four rounded corners, and radii of the four rounded corners are constant and are smaller than 0.5 mm.

5. A heat dissipation structure, comprising:

a copper substrate;

a heat dissipation fin assembly; and the heat pipe according to claim 1, wherein the evaporation end of the evaporation portion of the heat pipe is in contact with the copper substrate, and the condensation end of the condensation portion of the heat pipe is in contact with the heat dissipation fin assembly.

6. A heat dissipation structure, comprising:

a copper substrate;

a base; and the heat pipe according to claim 1, wherein the evaporation end of the evaporation portion of the heat pipe is in contact with the copper substrate, and the condensation end of the condensation portion of the heat pipe is in contact with the base;

wherein the condensation ends of the plurality of heat pipes are spaced apart from one another by the base.

7. A heat dissipation structure, comprising:

a copper substrate;

a base;

a heat dissipation fin assembly; and the heat pipe according to claim 1, wherein the evaporation end of the evaporation portion of the heat pipe is in contact with the copper substrate, and the condensation end of the condensation portion of the heat pipe is in contact with the base and the heat dissipation fin assembly;

wherein the condensation ends of the plurality of heat pipes are spaced apart from one another by the base.

* * * * *